US007775174B1

(12) United States Patent
Humphreys et al.

(10) Patent No.: US 7,775,174 B1
(45) Date of Patent: Aug. 17, 2010

(54) SELF-PROPELLED TOW BODY

(75) Inventors: Douglas E. Humphreys, Great Falls, VA (US); Ryan D. Schulz, Reston, VA (US); Alexander V. Roup, Sterling, VA (US); Neill S. Smith, Springfield, VA (US); Daniel N. Dietz, Alexandria, VA (US)

(73) Assignee: Vehicle Control Technologies, Inc., Reston, VA (US)

( * ) Notice: Subject to any disclaimer, the term of this patent is extended or adjusted under 35 U.S.C. 154(b) by 0 days.

(21) Appl. No.: 12/231,238

(22) Filed: Aug. 29, 2008

(51) Int. Cl.
*B63B 21/66* (2006.01)

(52) U.S. Cl. ..... 114/244; 114/253

(58) Field of Classification Search ..... 114/51, 114/244, 253, 254, 258, 259, 322; 367/133
See application file for complete search history.

(56) References Cited

U.S. PATENT DOCUMENTS

| | | | | |
|---|---|---|---|---|
| 3,105,453 | A * | 10/1963 | Hayes | 114/244 |
| 3,466,798 | A | 9/1969 | Speers et al. | |
| 3,647,253 | A | 3/1972 | Hettinger et al. | |
| 3,987,745 | A * | 10/1976 | Chaverebiere de Sal et al. | 114/245 |
| 4,010,619 | A * | 3/1977 | Hightower et al. | 114/322 |
| 4,705,331 | A | 11/1987 | Britton | |
| 5,120,099 | A | 6/1992 | Fletcher | |
| 5,686,694 | A | 11/1997 | Hillenbrrand et al. | |
| 5,713,293 | A | 2/1998 | Shiffler et al. | |
| 5,786,545 | A | 7/1998 | Hillenbrand | |
| 6,213,021 | B1 | 4/2001 | Pickett | |
| 6,359,834 | B1 | 3/2002 | English | |
| 6,390,012 | B1 | 5/2002 | Watt et al. | |
| 6,600,695 | B1 | 7/2003 | Nugent et al. | |
| 6,738,314 | B1 | 5/2004 | Teeter et al. | |
| 6,766,745 | B1 | 7/2004 | Kuklinski et al. | |
| 7,000,560 | B2 | 2/2006 | Wingett et al. | |
| 7,051,664 | B2 | 5/2006 | Robichaud et al. | |
| 7,156,036 | B2 | 1/2007 | Seiple | |
| 2002/0152945 | A1 | 10/2002 | Geriene et al. | |

OTHER PUBLICATIONS

Bondaryk et al. (presumably), "Automated Launch and Recovery of UUVs and Towed Assets from USSV", date is before Nov. 1, 2007, pp. 1-5/Frames 1-20, Brooke Ocean Technology Ltd.

U.S. Appl. No. 11/982,041, filed: Nov. 1, 2007; In re: Thomas Tureaud et al., entitled Docking Apparatuses and Methods.

Vehicle Control Technologies, Inc., "STTR Proposal No. N08A-016-0269—Expendable Glider for Oceanographic Research", Mar. 18, 2008, pp. 3-25, see specifically p. 20.

* cited by examiner

*Primary Examiner*—Lars A Olson
(74) *Attorney, Agent, or Firm*—Womble Carlyle Sandridge & Rice, PLLC

(57) ABSTRACT

An at least partially self-propelled vehicle is configured for being towed by a towing vehicle, by way of a tow line. Operation of the vehicles may be coordinated so that, for a length of the tow line that connects the vehicles, the length of the tow line is curved in a manner that inhibits the tow line from transferring oscillatory motion between the vehicles while the entirety of the length of the tow line may be under tension.

30 Claims, 8 Drawing Sheets

SELF-PROPELLED TOW BODY

STATEMENT OF GOVERNMENT SUPPORT

The present invention was made with Government support under the Small Business Innovation Research (SBIR) Program, namely SBIR N06-186 (Contract No. N65538-07-M-0127, dated Mar. 28, 2007) awarded by the United States Navy. The Government has certain rights in the invention.

TECHNICAL FIELD

The present invention generally relates to a towable vehicle and, more specifically, to an unmanned underwater vehicle that is towed and carries a sonar sensor.

BACKGROUND OF THIS DISCLOSURE

It is known for an underwater vehicle, which is towed and not self-propelled, to carry a sonar sensor, such as for mapping the ocean floor. Sometimes a heavy tow cable, dead weight depressor and/or dynamic-lift depressor is required to achieve the desired depth of the towed vehicle. Also, heave (up and down motion) and surge (back and forth motion) of the towing vehicle can result in the tow line erratically pulling the towed vehicle, so that the towed vehicle does not travel steadily and the sonar data is obtained under fluctuating conditions. It is known to decrease the speed of the towing vehicle in an effort to cause the towed vehicle to travel more steadily, but decreasing the speed can increase the amount of time that is required to obtain the sonar data and can increase the amount of heave transferred to the towed vehicle.

Accordingly, there is a need for a towable vehicle that provides a new balance of properties.

SUMMARY OF SOME ASPECTS OF THIS DISCLOSURE

One aspect of this disclosure is the provision of apparatus, systems and methods for improving performance of a sensor (e.g., a downwardly oriented sonar sensor) carried by an underwater vehicle that is connected by a tow line to a towing vehicle, and may be towed by the towing vehicle. For example, some aspects of this disclosure are directed to providing steady underwater traveling conditions for the underwater vehicle/sensor.

As alluded to above, the underwater vehicle may more specifically be a towable vehicle, and the effects of upper (e.g., surface) water conditions on the towable vehicle may be minimized or eliminating while the towable vehicle is submersed and traveling at a relatively high rate of speed. Generally described, this involves using a towable vehicle that is at least partially self-propelled, and coordinating operation of the towing vehicle and towable vehicle (e.g., having the towable vehicle at least partially propel itself) so that the towable vehicle is exposed to less towing tension while the towing vehicle is at least partially towing the tow line. Coordinating the operations comprises maneuvering, which may comprise steering, changing speed, and/or letting out or taking up the tow line. As a more specific example, the propulsion/steering system(s) of the towable vehicle may be operated in a coordinated manner with the towing vehicle so that any heave (up and down motion) and surge (back and forth motion) of the towing vehicle is substantially "decoupled" from the towable vehicle.

More specifically, operation of the towing vehicle and the towable vehicle may be coordinated in a manner so that, for a length of the tow line that extends from the towing vehicle to the towable vehicle while each of the towing and towable vehicles is at least partially propelling itself, the length of the tow line is curved in a manner that inhibits the tow line from transferring oscillatory motion between opposite ends of the tow line. For example, the tow line may be curved to define a concave shape that is forwardly oriented, with the lower end of the tow line being forward of an upper portion of the tow line. In addition, the entirety of the length of the tow line may be under tension.

In one example, the coordinating of the operations may be carried out so that the towing vehicle may travel along an upper path, and the at least partially self-propelled towable vehicle may travel along a lower path, with the lower path extending along (e.g., being substantially parallel to) and below (e.g., substantially beneath) the upper path.

On the other hand, in some situations any heave and surge of the towing vehicle may not be decoupled from the towable vehicle. These situations may include, for example, when the towable vehicle is being initially introduced into the water; when the tow line, with the towable vehicle attached thereto, is initially being unreeled; when the tow line, with the towable vehicle attached thereto, is being reeled in; when surface water conditions are relatively smooth; when the towable vehicle is not collecting sonar data; and/or when it is acceptable to obtain sonar data without the towable vehicle being substantially "decoupled" from the surface conditions. In these situations, the propulsion system of the towable vehicle may be turned off to reduce power consumption by the towable vehicle. Accordingly, the towable vehicle that is at least partially self-propelled is typically configured for being fully towed underwater by the towing vehicle.

Other aspects and advantages of the present invention will become apparent from the following.

BRIEF DESCRIPTION OF THE DRAWINGS

Having described some aspects of this disclosure in general terms, reference will now be made to the accompanying drawings, which are not necessarily drawn to scale, and are briefly described below.

DETAILED DESCRIPTION

Referring now in greater detail to the drawings, in which like numerals refer to like parts throughout the several views, exemplary embodiments of this disclosure are described in the following.

Figure 1:
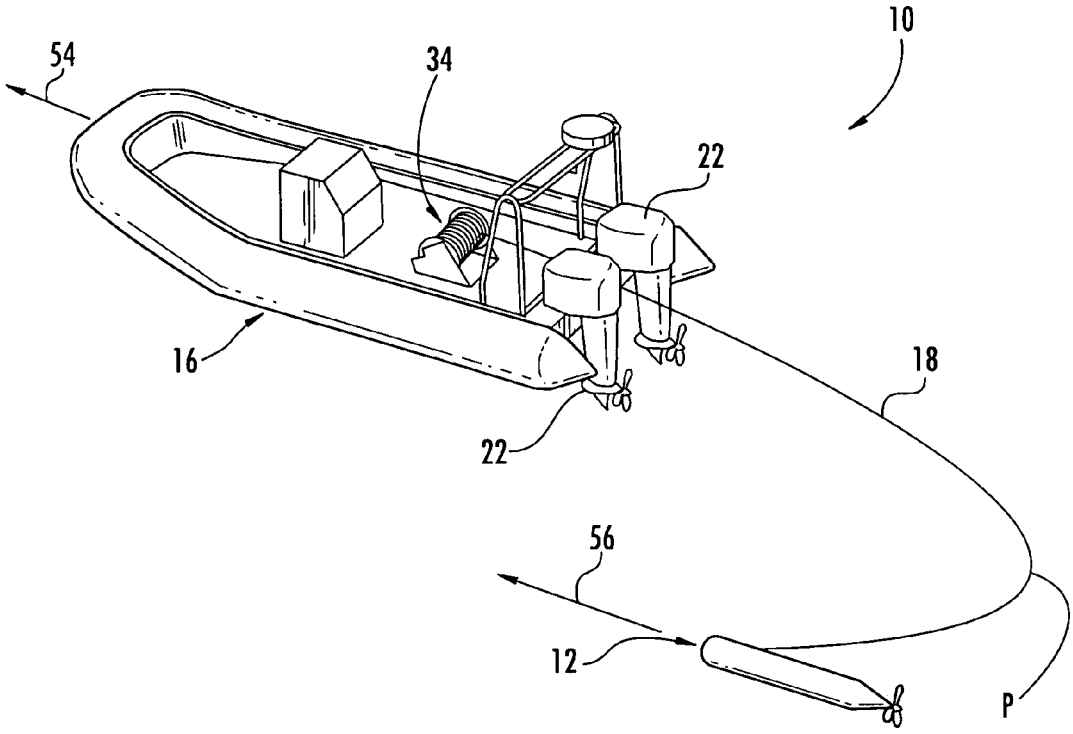
FIG. 1 is a schematic, right rear perspective view showing a system that includes a towable vehicle connected to a towing vehicle by a tow line, in accordance with a first embodiment of this disclosure.
Figure 2:
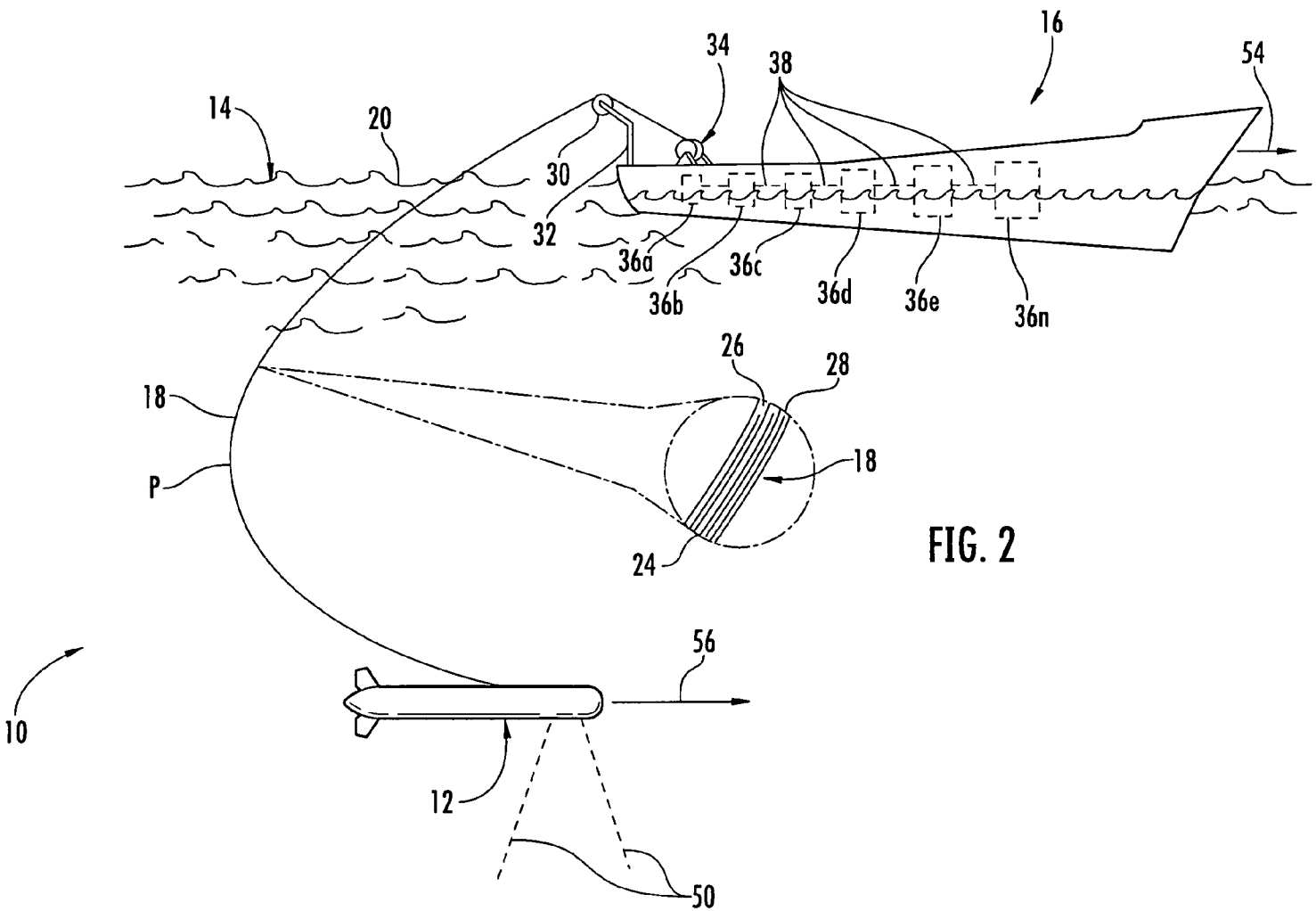
FIG. 2 is a schematic, left elevation view of the system of FIG. 1.

FIGS. 1 and 2 are schematic views showing a system 10 that includes a towable vehicle 12 that is submerged in water 14 and connected to a towing vehicle 16 by a tow line 18, in accordance with a first embodiment of this disclosure. The system 10 will be described in the following, in accordance with the first embodiment. As best understood with reference to FIG. 2, the towing vehicle 16 is a boat floating on the wavy surface 20 of the body of water 14 that contains the towable vehicle 12.

As will be discussed in greater detail below, the system 10 may be operated so that propulsion and steering systems of the towable and towing vehicles 12, 16 are operated in a coordinated manner so that any heave (up and down motion) and surge (back and forth motion) of the towing vehicle 16 is substantially "decoupled" from the towable vehicle 12 while the vehicles 12, 16 travel relatively fast along respective paths that are substantially parallel and vertically spaced apart. The decoupling seeks to increase (e.g., is for increasing) the steadiness of the towable vehicle 12. As one specific example that is discussed in greater detail below, FIGS. 1 and 2 illustrate that the propulsion and steering systems of the towable vehicle 12 are being operated so that the towable vehicle is completely self-propelled (i.e., the towing vehicle 16 is not towing the towable vehicle by the tow line 18).

As best understood with reference to FIG. 1, the towing vehicle 16 may be a conventional manned or unmanned boat that has been retrofitted for operating as described herein. The towing vehicle 16 may include a conventional propulsion system and a conventional steering system. As shown in FIG. 1, the propulsion system of the towing vehicle 16 includes two conventional outboard motors 22. The steering system includes the outboard motors 22 being conventionally mounted for pivoting about respective upright axes, and a subsystem (not shown) of hydraulic components and/or cables for controlling the pivoting of the outboard motors 22 respectively about the axes. A wide variety of different towing vehicles 16 are within the scope of the present invention, and the propulsion and steering systems of the towing vehicle may be any suitable types of such systems. For example, the towing vehicle 16 may alternatively be an unmanned underwater vehicle that includes propulsion and steering systems.

As best understood with reference to FIG. 2, the tow line 18 may extend over an idler pulley 30 that is carried by a crane-like and/or arm-like boom 32, which is carried by the towing vehicle 16. The tow line 18 may be unreeled/let out and reeled in by way of a winch 34, which is carried by the towing vehicle 16. It may be satisfactory for the boom 32 and associated pulley 30, as well as the winch 34, to be conventional. Alternatively, the tow line 18 may be unreeled/let out and reeled in by any other acceptable method and/or devices for letting out and retrieving the tow line.

As best understood with reference to the enlarged portion of FIG. 2, the schematically illustrated tow line 18 typically includes a cable 24 for strength (e.g., a metal cable), it may optionally further include sheathed metal power line(s) 26 for providing electrical power to the towable vehicle 12, and it may optionally further include communication line(s) 28 (which may include a fiber optic cable 28) over which the vehicles 12, 16 communicate back and forth with one another. For example, all or a portion of the electrical power needed to operate the towable vehicle 12 (e.g., electricity for the electric motor of the propulsion system of the towable vehicle) may be provided to the towable vehicle by way of the power line(s) 26. As an additional example, data from one or more sensors (e.g., a downwardly oriented sonar sensor) carried by the towable vehicle 12 may be provided to operational component(s) (e.g., a computer) of the towing vehicle 16 in real time by way of the communication line(s) 28.

FIG. 2 is schematic, for example, because the towing vehicle 16 may include numerous operational components 36*a*, 36*b*, 36*c*, 36*d*, 36*e* . . . 36*n* ("operational components 36*a-n*") that are carried by the towing vehicle and are schematically illustrated by dashed lines in FIG. 2. The operational components 36*a-n* are for respectively controlling, performing and/or aiding in the performance of operations associated with the towing vehicle 16 and may be in the form of hardware, software modules and combinations thereof. The operational components 36*a-n* may include an electrical power supply; a sonar which may operate using acoustic signals; a magnetometer; actuators; transceivers (e.g., communication transceivers) for communicating with one or more other vehicles, such as the towable vehicle 12; controller(s) (e.g., computer(s)) for use, for example, in at least partially controlling and/or aiding a user in operation of the towing vehicle and/or the towable vehicle; a global positioning system ("GPS") receiver (e.g., a GPS navigational system); an autopilot system for controlling operations of the steering and propulsion systems of the towing vehicle; any other feedback components for helping to coordinate operations of the towing and towable vehicles 12, 16; and/or any other devices that may be useful, such as for carrying out operations described in this disclosure. As an example, a power supply (e.g., which is one of the operational components 36*a-n*) of the towing vehicle 16 may be in the form of a battery or another suitable device for providing electricity to the towable vehicle 12 by way of the powerline(s) 26 of the tow line 18.

One of ordinary skill in the art will understand that, for example, a GPS receiver is not novel per se, and that the GPS receiver can receive signals from satellites to determine the location of the GPS receiver, and the direction and speed at which the GPS receiver is traveling. As an additional example, one of ordinary skill in the art will understand that autopilot systems are not novel per se.

A communication transceiver (e.g., which is one or more of the operational components 36*a-n*) of the towing vehicle 16 may be in the form of transmitter(s) and receiver(s) that are for communicating with the towable vehicle 12 wirelessly and/or by way of the communications line(s) 28 of the tow line 18 or by any other suitable means, such as by way of radio frequency signals, acoustic signals, digital signals, optical signals or any other suitable signals. As a more specific example, the vehicles 12, 16 may communicate with one another, while the towable vehicle is underwater, using a WHOI (Woods Hole Oceanographic Institution) ACOMMS (acoustic communications) protocol or any other suitable protocol. The operational components 36*a-n* of the towing vehicle communicate with one another by way of internal communication paths (e.g., wirelessly, and/or by way of wire(s) and/or cables). Some of the internal power supply paths and internal communication paths that respectively extend between the operational components 36*a-n* of the towing vehicle 16 are schematically illustrated by dashed lines in FIG. 2, and only a few of these paths/dashed lines are identified by their reference numeral 38 in FIG. 2 in an effort to clarify the view.

Figure 3:
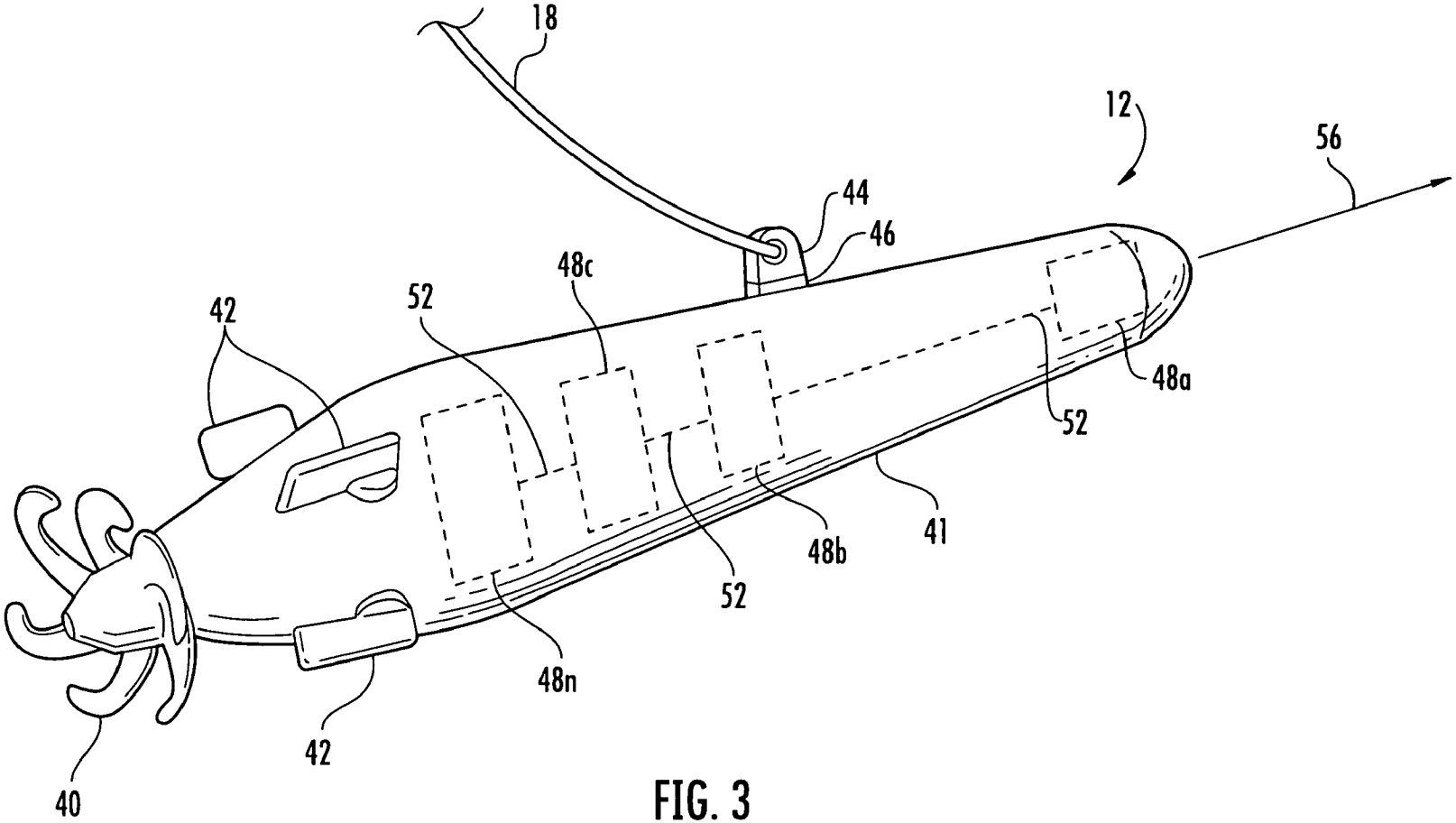
FIG. 3 is an isolated, schematic, left rear perspective view of the towable vehicle of FIGS. 1 and 2.

FIG. 3 is an isolated, schematic view of the towable vehicle 12. As discussed in greater detail below, the towable vehicle 12 is configured for being towed, and it is also at least partially self-propelled. The towable vehicle 12 may be generally characterized as being, to at least some extent, a combination of a conventional tow body and a conventional autonomous unmanned underwater vehicle that has been retrofitted for operating as described herein. For example, the towable vehicle's propeller 40 may be different than that of a conventional unmanned underwater vehicle because the towable vehicle 12 may be operated to at least partially tow the tow line 18, as will be discussed in greater detail below. In addition, the towable vehicle 12 is typically equipped with at least some equipment for use in coordinating operations with the towing vehicle 16, as will be discussed in greater detail below. Whereas a wide variety of differently sized and shaped towable vehicles are within the scope of the present invention, the towable vehicle 12 schematically shown in FIG. 3 has a hull 41 that is at least generally torpedo-shaped. That is, the hull 41 may be substantially cylindrical between its front and rear ends.

The towable vehicle 12 includes one or more at least somewhat conventional propulsion systems. Thrust from the propulsion system(s) of the towable vehicle 12 may be used to cause the towable vehicle to descend and travel at the desired depth. As best understood with reference to FIG. 3, the propulsion system of the towable vehicle 12 includes an electric motor (not shown) that drives the propeller 40 that projects from a somewhat round, rear end of the hull 41. Optionally, the towable vehicle 12 includes one or more at least somewhat conventional steering systems. In the first embodiment, the steering system of the towable vehicle 12 includes actuators (not shown) for respectively moving movable fins 42 that are for steering the towable vehicle. A wide variety of different (e.g., differently shaped) towable vehicles 12 are within the scope of the present invention, and the propulsion and steering systems of the towable vehicle may be any suitable types of such systems.

The tow line 18 is connected to a tow fitting 44 that is mounted to the hull 41 of the towable vehicle 12. The tow fitting 44 is mounted to the upper side of the hull 41, and typically about midway between the front and rear ends of the hull, so that the towable vehicle 12 may be efficiently towed by towing vehicle 16 by way of the tow line 18/tow fitting 44. Accordingly and in accordance with one aspect of this disclosure, the towable vehicle 12 may be characterized as a tow body that is at least partially self-propelled.

As shown in FIG. 3, a sensor 46, such as for measuring tension (e.g., a strain gauge) is mounted between the hull 41 of the towable vehicle 12 and the tow fitting 44. The tension sensor 46 is for sensing the towing tension applied to the towable vehicle 12 by the tow line 18 and/or applied by the towable vehicle to the tow line 18. The tension sensor 46 may be any type of sensor suitable for sensing the subject towing tension, and the tension sensor 46 may be positioned at any suitable position for sensing the subject towing tension.

FIG. 3 is schematic, for example, because the towable vehicle 12 includes numerous operational components 48*a*, 48*b*, 48*c* . . . 48*n* ("operational components 48*a-n*") that are schematically shown as being contained within the hull 41 and hidden from view (i.e., the operational components are schematically illustrated by dashed lines in FIG. 3). The operational components 48*a-n* are for respectively controlling and/or performing operations of the towable vehicle 12. The operational components 48*a-n* may include an electrical power supply; sonar; depth sensor; magnetometer; electric motor for driving the propeller 40; actuators; a transceiver (e.g., a communication transceiver) for communicating with another vehicle, such as the towing vehicle 16; controller(s) (e.g., computer(s)) for at least partially controlling operation of the towable vehicle 12; an autopilot system for controlling operations of the steering and propulsion systems of the towable vehicle; any other feedback components for helping to coordinate operations of the towing and towable vehicles 12, 16; and/or any other devices that may be useful, such as for carrying out operations described in this disclosure. The dashed lines 50 in FIG. 2 schematically illustrate that the operational component 48*a* (FIG. 3) is a downwardly oriented sensor (e.g., a sonar sensor) that may be for sensing the sea floor or any other target below the towable vehicle 12. For example, the dashed lines 50 in FIG. 2 schematically illustrate the field of view of the downwardly oriented sensor 48*a*. The sensor 48*a* as well as its field of view can vary; any type of suitable sensor 48*a* with any suitable field of view may be used. In one example, the sensor 48*a* is a sonar sensor that may be downwardly and/or sideways oriented. In a specific example, the towable vehicle 12 has a length of 12.75 inches and the sensor 48*a* is a Synthetic Aperture Sonar (SAS) which points to the side and downward. In another specific example, the towable vehicle 12 has a length of 21 inches and the sensor 48*a* is a Low Frequency Broad Band (LFBB) sonar which points to the side and downward.

The communication transceiver (e.g., which is one of the operational components 48*b-n*) may be in the form of transmitter(s) and receiver(s) that are for communicating with the towing vehicle 16 wirelessly and/or by way of communications line(s) 28 of the towline 18 (FIG. 2) or by any other suitable means, such as by way of radio frequency signals, acoustic signals, digital signals, optical signals or any other suitable signals. The operational components 48*a-n* of the towable vehicle 12 may communicate with one another by way of internal communication paths (e.g., wirelessly, and/or by way of wire(s) and/or cables). Some of the internal power supply lines and internal communication paths that respectively extend between the operational components 48*a-n* of the towable vehicle 12 are schematically illustrated by dashed lines 52 in FIG. 3.

One of ordinary skill in the art will understand that FIGS. 2 and 3 are in some regards very schematic with respect to the features therein that are shown by broken lines, and that the operational components and internal power supply lines/internal communication paths shown by dashed lines may be in a variety of different configurations, including some of the features being arranged in different combinations and subcombinations, one or more of the features being omitted, different component(s) being included and/or additional component(s) being included.

Examples of operation of the system 10 will be described in the following, in accordance with the first embodiment of this disclosure. The towable vehicle 12 is typically carried on the deck of the towing vehicle 16 while the towing vehicle travels to a position that is at least close to where the towable vehicle is to be used underwater. If the towable vehicle 12 is small enough, it may be manually placed in the water 14. Alternatively, the towable vehicle 12 may be placed in the water 14 using the crane-like and/or arm-like boom 32, or in any other suitable manner. Then, the tow line 18 may be unreeled/let out by way of the winch 34, or any other suitable mechanism. The depth at which the towable vehicle 12 travels is typically at least partially controlled by how much of the tow line 18 is unreeled. In addition, the propulsion and steering systems of the towable vehicle 12 may be operated in a manner that at least partially controls the depth at which the towable vehicle travels. The propulsion and/or steering systems of the towable vehicle 12 may be used to increase the depth at which the towable vehicle travels such as by thrusting and/or steering downwardly, so that it typically will not be necessary to use a relatively heavy tow cable, dead weight depressor or dynamic-lift depressor for the purpose of increasing the depth at which the towable vehicle travels.

As best understood with reference to FIGS. 1 and 2, and in accordance with the first exemplary embodiment, the system 10 may be operated so that the towing vehicle 16 travels along an upper path 54, the towable vehicle 12 travels along a lower path, which is more specifically an underwater path 56, and the vehicles' paths 54, 56 are in a substantially aligned formation. The substantially aligned formation of the vehicles' paths 54, 56 comprises the paths 54, 56 being arranged so that the underwater path 56 extends along (e.g., is substantially parallel to) and is below (e.g., substantially beneath/substantially vertically aligned with) the upper path 54. The vehicles' paths 54, 56 may be vertically spaced apart by at least about 5 feet, at least about 10 feet, at least about 20 feet, at least about 30 feet, at least about 50 feet, at least about 75 feet, at least about 100 feet, at least about 200 feet, at least about 300 feet, at least about 400 feet, at least about 500 feet, or any other suitable distance.

In addition to FIGS. 1 and 2 illustrating the vehicles' paths 54, 56 being in their substantially aligned formation, FIGS. 1 and 2 also illustrate that the length of the tow line 18 that extends from the towing vehicle 16 to the towable vehicle 12 is in a substantially curved formation. The substantially curved formation of the tow line 18 comprises the length of the tow line 18 between the vehicles 12, 16 being substantially curved (e.g., the length of the tow line forms a "hooked" catenary, and defines a forwardly facing concave shape, with the lower end of the tow line being forward of a relatively upper portion of the tow line). When the length of the low line between the vehicles 12, 16 is sufficiently long in relation to the conditions at the surface 20 of the water, the substantially curved formation of the tow line 18 is operative for substantially "decoupling" the towable vehicle 12 from any heave (up and down motion) and surge (back and forth motion) of the towing vehicle 16.

For example, and with respect to farthest rearward point P (FIGS. 2 and 3) of the substantially curved formation of the tow line 18, the lower end of the tow line may be at least about 1 foot forward of the farthest rearward point P, at least about 1.5 feet forward of the farthest rearward point P, at least about 2 feet forward of the farthest rearward point P, at least about 2.5 feet forward of the farthest rearward point P, at least about 3 feet forward of the farthest rearward point P, at least about 3.5 feet forward of the farthest rearward point P, at least about 4 feet forward of the farthest rearward point P, at least about 4.5 feet forward of the farthest rearward point P, at least about 5 feet forward of the farthest rearward point P, at least about 6 feet forward of the farthest rearward point P, or more than about 6.5 feet forward of the farthest rearward point P while the vehicles 12, 16 are both traveling forward at about the same speed so that the entire length of the substantially curved tow line 18 is under tension due to the water 14 resisting the forward movement of the substantially curved tow line. For example and in accordance with the first embodiment of this disclosure, the speed of each of the vehicles 12, 16 along their respective paths 54, 56 may be at least about 3 knots, at least about 4 knots, at least about 5 knots, at least about 6 knots, at least about 7 knots, at least about 8 knots, at least about 9 knots, or at least about 10 knots, or it may be more than 11 knots, or any other suitable speed.

Very generally described, while the vehicles' paths 54, 56 are in their substantially aligned formation and the tow line 18 is in its substantially curved formation, the towable vehicle's sensor 48*a* (e.g., the downwardly oriented sonar or any other suitable sensor) may be operated, and the paths 54, 56 may together make numerous (back and forth) sweeps across the ocean floor, or the like, for mapping purposes, for purposes of searching for natural resources (e.g., oil), or for any other suitable purposes. Thereafter, operation of the propulsion and/or steering systems of the towable vehicle 12 may be ceased, and then the towable vehicle is typically brought to the towing vehicle 16 by reeling in the tow line 18. For example, the tow line 18 is typically reeled in by way of the winch 34 (e.g., the tow line is wound up onto a spool or drum through the operation of a manual crank or more typically through the operation of a motor that is connected to the spool or drum by appropriate gearing) or by using any other suitable apparatus and/or method. Then, as part of the reeling or an additional operation, the towable vehicle 12 may be brought onboard the towing vehicle 16. For example, the towable vehicle 12 may be reeled in so that it is suspended by the crane-like and/or arm-like boom 32, and thereafter the boom 32 may be pivoted, swiveled and/or articulated in a manner that the towable vehicle is placed on the deck (e.g., lowered onto the deck by unreeling a short portion of the tow line 18) of the towing vehicle 16 or otherwise placed in a desired location. Thereafter, the towable vehicle may be reused numerous times.

Whereas in the foregoing the launch and recovery of the towable vehicle 12 have been discussed with reference to the crane-like and/or arm-like boom 32, any suitable launch and recovery systems ("LARS") may be used. For example, the launch and recovery systems and methods may include a stern launch using a ramp and an over the side launch.

In accordance with the first embodiment of this disclosure, the system 10 may be operated in several different modes. For example, several different modes of operation are specifically referred to in the following. In each of the different modes of operation specifically referred to below, the vehicles' paths 54, 56 are in their substantially aligned formation, but the vertical distance between the paths 54, 56 may vary from mode to mode. In some of the different modes of operation specifically referred to below, the tow line 18 is in its substantially curved formation, but the curvature of the tow line varies from mode to mode. In other of the different modes of operation specifically referred to below, the tow line 18 is not in its substantially curved formation (e.g., in contrast to the tow line 18 being in its substantially curved formation, the tow line is straight or substantially straight in some of the modes of operation discussed below).

Figure 4:
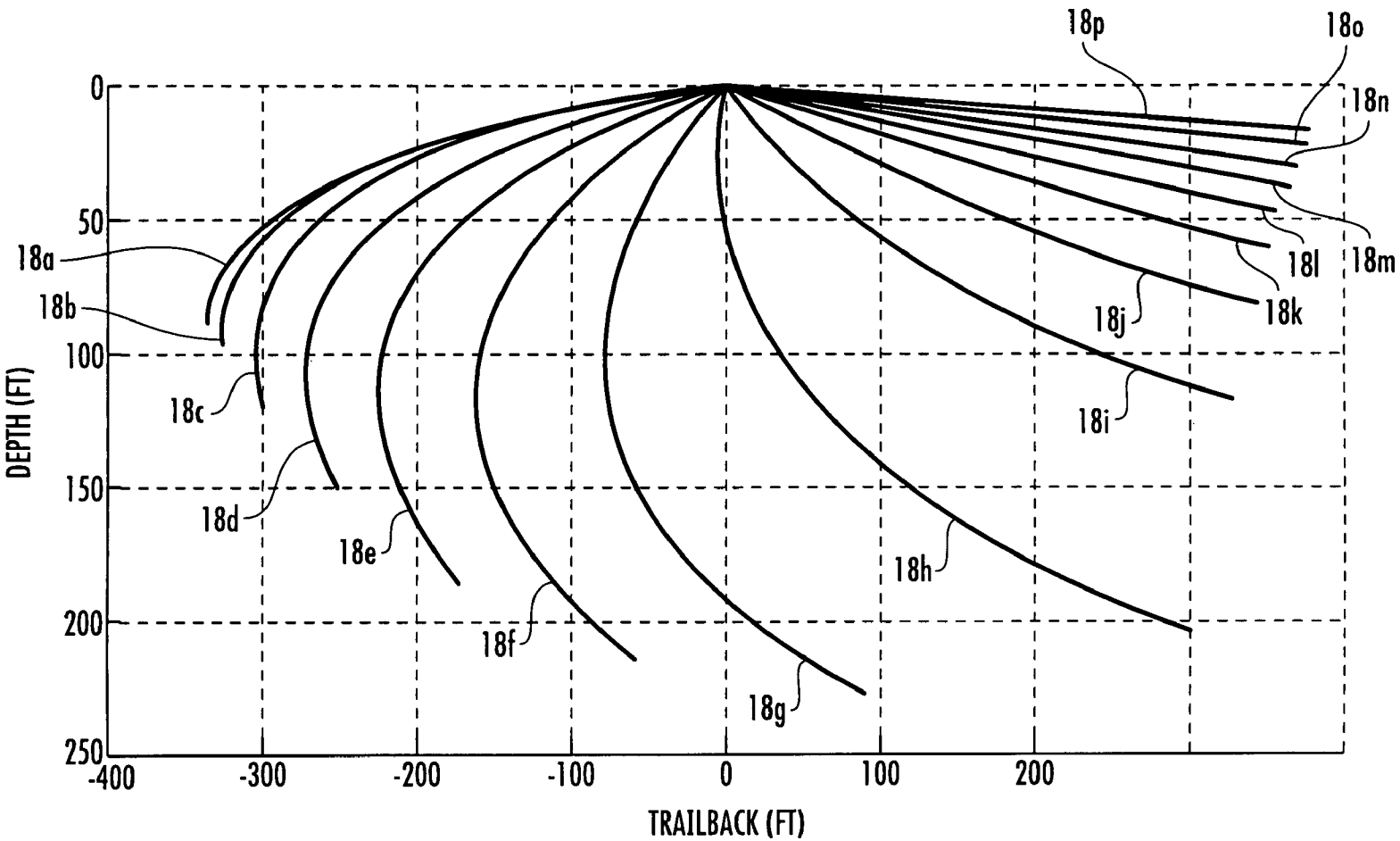
FIG. 4 is a chart that includes isolated, schematic, left elevation views of a length of the tow line that extends from the towing vehicle to the towable vehicle, with the length of the tow line being shown in sixteen different theoretically calculated configurations respectively corresponding to sixteen different potential modes of operation for the system, in accordance with the first embodiment of this disclosure.

FIG. 2 is a schematic, left elevation view that shows the length of the tow line 18 that extends from the towing vehicle 16 to the towable vehicle 12 in the tow line's substantially curved formation, in accordance with one exemplary mode of operation of the system 10. Similarly, FIG. 4 is a chart that includes isolated, schematic, left elevation views of a length of the tow line 18 that extends from the towing vehicle 16 to the towable vehicle 12, with the tow line being shown in sixteen different theoretically calculated configurations respectively corresponding to sixteen different potential modes of operation for the system 10, in accordance with the first embodiment of this disclosure. Other modes of operation are within the scope of this disclosure.

For the sixteen different potential modes of operation schematically shown in FIG. 4, the length of the tow line 18 that extends from the towing vehicle 16 to the towable vehicle 12 is respectively referred to as tow lines 18*a*-18*p*. Each of the tow lines 18*a*-18*p* is the same length. As best understood with reference to the lower, horizontal axis in FIG. 4, the upper end of each of the tow lines 18*a*-18*p* is located at the zero trailback position (e.g., adjacent the transom of the towing vehicle 16). Operating a towing vehicle and a tow body to provide the tow line 18*a* of FIG. 4 (i.e., conventional behind the ship towing, which may also be referred to as "dead tow") and operating a ship and a propelled unmanned underwater vehicle that is connected to the ship by a tow line to provide the tow line 18*p* of FIG. 4 (i.e., conventional ahead of ship system) are both not novel per se.

When calculating the modes of operation respectively represented by the tow lines 18*a*-18*p* of FIG. 4, the speed of the towing vehicle 16 was held constant, paths 54, 56 were in substantially aligned formations with respect to one another, the thrust provided by the propulsion system of the towable vehicle 12 was varied in increments of forty, from 0 to 600, and the speed of the vehicles 12, 16 along their respective paths 54, 56 was fast enough so that the entire lengths of the tow lines 18*a*-18*p* are under tension due to the tow lines being towed and in some modes also due to the resistance resulting from the curved tow lines being pulled through the water 14. More specifically, the thrusts provided by the propulsion system of the towable vehicle 12 were 0, 40, 80, 120, 160, 200, 240, 280, 320, 360, 400, 440, 480, 520, 560 and 600 pounds respectively for the tow lines 18*a*-18*p*.

At the lower thrusts of the towable vehicle 12 schematically illustrated in FIG. 4 (e.g., tow lines 18*b* and 18*c*), the towable vehicle 12 is simultaneously self-propelled and continues to be towed by way of the tow line 18 (i.e., the towable vehicle is partially self-propelled). At the higher thrusts of the towable vehicle 12 schematically illustrated in FIG. 4, the towable vehicle 12 is completely self-propelled and no longer towed by way of the tow line 18 (e.g., the towable vehicle may tow the tow line). At some of the thrusts, the towable vehicle 12 tows one end of the tow line 18 at the same time as the towing vehicle 16 tows the other end of the tow line. FIG. 4 illustrates that as thrust provided by the propulsion system of the towable vehicle 12 is increased, the trailback position of the towable vehicle moves from behind the towing vehicle 16 to in front of the towing vehicle. The intermediate tow lines shown in FIG. 4 may offer the greatest potential for decoupling motions of the towing vehicle 16 from the towable vehicle 12.

In accordance with the first embodiment, the propulsion system of the towable vehicle 12 may not be turned on until after the towable vehicle is being towed by the towing vehicle 16. Then, when the propulsion system of the towable vehicle 12 is turned on at a relatively low level of thrust, the thrusting of the propulsion system of the towable vehicle may result in an increase in the curvature of the tow line 18 and thereby reduce the transferring of oscillatory motion between opposite ends of the tow line (e.g., to at least partially isolate the towable vehicle from any heave (up and down motion) and surge (back and forth motion) of the towing vehicle 16). The increased curvature of the tow line 18 seeks to increase (e.g., is for increasing) the steadiness of the towable vehicle 12.

In addition, the thrusting of the propulsion system of the towable vehicle 12 may be used to increase depth of the towable vehicle, for example with the tow line 18 being simultaneously unreeled from the spool or drum of the winch 34 to enable the increase in depth and substantial curvature of the tow line. As shown in FIG. 4, as the thrusting of the propulsion system of the towable vehicle 12 increases to the intermediate range of thrusts, the curvature of the tow line 18 (and thereby reduction in the transferring of oscillatory motion between opposite ends of the length of the tow line) and the depth may increase. As shown in FIG. 4, as the thrusting of the propulsion system of the towable vehicle 12 increases to the higher end of the range of thrusts, the curvature of the tow line 18 (and thereby reduction in the transferring of oscillatory motion between opposite ends of the length of the tow line 18) and the depth may decrease. Therefore, it may be preferred in some situations (although it is not required) for the propulsion system of the towable vehicle 12 to operate in the intermediate range of thrusts.

Notwithstanding the foregoing, it may be desirable in some situations to operate the propulsion system of the towable vehicle 12 in the relatively lower ranges of thrusts (e.g., so that at least the shape of the tow line 18*b* is provided), because at the relatively lower thrust it may be relatively easy to coordinate the operations of the vehicles 12, 16 in a manner that maintains the vehicles' paths 54, 56 in their substantially aligned formation and maintains the tow line 18 in its substantially curved formation. For example, with the towing vehicle 16 operating at a reasonably high speed and the propulsion system of the towable vehicle 12 operating at relatively low thrust, the reduced towing tension applied to the towable vehicle may still be relatively high enough to keep the vehicles' paths 54, 56 in their substantially aligned formation, so that the steering system of the towable vehicle may not need to be operated in order to keep the vehicles' paths 54, 56 in their substantially aligned formation. Nonetheless, the tow line 18 may be in its substantially curved formation. That is, the tow line 18 may be sufficiently curved in a manner that advantageously reduces the transferring of oscillatory motion between opposite ends of the tow line. In contrast, when operating the propulsion system of the towable vehicle 12 in the relatively higher ranges of thrust so that the towable vehicle is, for example, beneath or ahead of the towing vehicle 16, it may be necessary, for example, to operate the steering system of the towable vehicle 12 in order to coordinate the operations of the vehicles 12, 16 in a manner that causes the vehicles' paths 54, 56 to be in their substantially aligned formation and the tow line 18 to be in its substantially curved formation.

As discussed in the following, there are numerous different feedback systems, or the like, that may be used to coordinate the operations of the vehicles 12, 16 in a manner that causes the vehicles' paths 54, 56 to be in their substantially aligned formation and the tow line 18 to be in its substantially curved formation. Coordinating the operations of the vehicles 12, 16 in a manner that causes the vehicles' paths 54, 56 to be in their substantially aligned formation and the tow line 18 to be in its substantially curved formation may include operating one or more of the winch 34, the propulsion system of the towing vehicle 16, the steering system of the towing vehicle, the propulsion system of the towable vehicle, and the steering system of the towable vehicle. Nonetheless, in some of the following examples, achievement of the tow line's substantially curved formation and/or the path's substantially aligned formation is described primarily with reference to operating one or more of the winch 34, the propulsion system of the towable vehicle 12, and the steering system of the towable vehicle. For example, the towing vehicle 16 may be considered easier to more accurately navigate than the towable vehicle 12 since the towing vehicle may include a GPS receiver for determining its location (e.g., its autopilot system may be a GPS-based navigation system); therefore, it may be preferred (but is not required) for the towing vehicle to the "leader", and for the towable vehicle to be maneuvered relative to the towing vehicle in order to maintain the substantially aligned formation of the vehicles' paths 54, 56 and the substantially curved formation of the tow line 18.

For feedback purposes, the towing tension applied to the towable vehicle 12 may be determined using the tension sensor 46 (FIG. 3). In addition or alternatively, (e.g., as an indirect indication of the towing tension applied to the towable vehicle 12) the curvature of the tow line 18 may be determined using the fiber optic cable 28 of (e.g., that is embedded in) the tow line 18. For example, one of the operational components 36*a-n* (e.g., an optical signal transmitter) of the towing vehicle 16 and one of the operational components 48*a-n* of the towable vehicle 12 (e.g., an optical signal receiver) may be respectively connected to opposite ends of the fiber optic cable 28 of the tow line 18. Attenuation of optical signals in the fiber optic cable 28 may be determined using the optical signal transmitter and receiver. The attenuation of the optical signals in the fiber optic cable 28 is indicative of the extent of the bend in the fiber optic cable (i.e., curvature of the tow line 18), with increased attenuation being indicative of increased bending (i.e., increased curvature in the tow line). Generally described and in accordance with one acceptable example, the fiber optic cable 28 that is associated with (e.g., imbedded in) the tow line may be used to measure the shape of (e.g., the curvature of) the tow line at 20 Hz.

Information or signals from the tension sensor 46 and/or the optical signal receiver may be used in a feedback loop that causes action to be taken in response to the signals. For example, if the signals fall out of a predetermined range, exceed a predetermined threshold and/or fall below a predetermined threshold, the winch 34, the propulsion system of the towable vehicle 12, and/or the steering system of the towable vehicle may be operated in a manner that seeks to adjust the towing tension applied to the towable vehicle 12 and/or the curvature of the tow line 18. For example, the tow line 18 may be unreeled from the spool or drum of the winch 34 in an effort to increase the curvature of the tow line and decrease the towing tension applied to the towable vehicle 12.

In accordance with the first embodiment of this disclosure, the winch 34 may optionally be a "smart winch" (e.g., a motion compensating winch). A smart winch is a conventional winch that is operative for reducing the transfer of heave and surge motions from a towing vehicle to a vehicle being towed. For example, the smart winch 34 may include features (e.g., one or more tension sensors and controllers (e.g., a computer)) for operating the winch in a manner that reduces the transfer of any heave (up and down motion) and surge (back and forth motion) of the towing vehicle 16 to the towable vehicle 12. In addition, the coordinating of the operations of the vehicles 12, 16 in accordance with this disclosure may include simultaneously coordinating the operation of one or more of the vehicles 12, 16 with the operation of the smart winch 34 to further reduce any transfer of oscillatory motion from the towing vehicle 16 to the towable vehicle 12 and thereby increase the steadiness of the towable vehicle 12. That is, the control systems of the vehicles 12, 16 may be integrated with the control system of the smart winch 34 for enhancing the steadiness of the towable vehicle 12. For example, one or more of the towing vehicle's operational components 36*a-n* may be characterized as being schematically illustrative of a controller of the smart winch 34.

As another example, if the thrust provided by the propulsion system of the towable vehicle 12 is at a relatively low level, it may be increased in an effort to increase the curvature of the tow line 18 and decrease the towing tension applied to the towable vehicle. Typically the operation of the propulsion system of the towable vehicle 12 will be adjusted so that a steady state operation is reached in which the forward speed of the towable vehicle substantially matches forward speed of the towing vehicle 16, and in some situations the towing vehicle is maintained at a position in which it is at least slightly ahead of the towable vehicle, for example as shown in FIGS. 1 and 2. As an additional example, the steering system of the towable vehicle 12 may be operated in a manner that seeks to decrease the depth of the towable vehicle in order to increase the curvature of the tow line 18 and decrease the towing tension applied to the towable vehicle.

As alluded to above, if the propulsion system of the towable vehicle 12 is providing a relatively large amount of thrust, the towable vehicle may unintentionally travel to the right or left of its intended course (if corrective steering action us not undertaken), so that the underwater path 56 becomes, for example, oblique to the upper path 54. Any such unintentional traveling of the towable vehicle 12 to the right or left (e.g., the underwater path 56 becoming oblique to the upper path 54) may be observed or otherwise detected, for example, using a sonar of the towing vehicle 16 that is directed toward the towable vehicle 12, or a sonar of the towable vehicle that is directed toward the towing vehicle. Information or signals from such sonars may be used in a feedback loop that causes corrective actions to be taken in response to the signals. For example, if the signals fall out of a predetermined range, exceed a predetermined threshold and/or fall below a predetermined threshold, the steering system of the towing vehicle 16 and/or the steering system of the towable vehicle 12 may be operated in a manner that seeks to cause the paths 54, 56 to be in their substantially aligned formation.

A human operator may perform one or more roles in the fulfillment of one or more of the above-discussed feedback loops, or other suitable feedback looks. For example, a human operator on the towing vehicle 16 may view a sonar display indicating the changing position of the towable vehicle 12 with respect to the towing vehicle, and the human operator may cause the towable vehicle and/or the towing vehicle to be steered and propelled in a manner that seeks to keep the vehicles' paths 54, 56 in their substantially aligned formation and the tow line 18 to be in its substantially curved formation.

On the other hand, the feedback loops for facilitating coordinated operation between the vehicles 12, 16 may be completely automated, such as by using software modules that may be executed on computer(s) of one or more of the operational components 36*a-n* and/or the operational components 48*a-n* that serve as the autopilot system of the towable vehicle 12. In addition or alternatively, the propulsion and steering systems of the towing vehicle 16 may be similarly controlled in order to cause the vehicles' paths 54, 56 to be in their substantially aligned formation and the tow line 18 in its substantially curved formation.

There are other examples of automated feedback systems that may be used to coordinate the operations of the vehicles 12, 16 in order to cause the vehicles' paths 54, 56 to be in their substantially aligned formation and the tow line 18 in its substantially curved formation. For example, the towing vehicle 16 may include a homing beacon (e.g., which is a first component of an acoustic underwater positioning system ("AUPS")), and the towable vehicle 12 may include a homing transceiver (e.g., which is a second component of the AUPS) for use in homing in on the homing beacon/towing vehicle. Signals from the homing transceiver may be used to control steering of the towable vehicle 12 to the right and left, in a manner that seeks to cause the vehicles' paths 54, 56 to be in their substantially aligned formation. At the same time, information about the depth of the towable vehicle 12 (e.g., information from a depth gauge of the towable vehicle) may be used to control the up and down steering of the towable vehicle 12. At the same time, signals regarding the signal attenuation in the fiber optic cable 28 of the tow line 18 and/or the signals from the tension sensor 46 may be used for adjusting the thrust provided by the propulsion system of the towable vehicle 12. Numerous different feedback loops are discussed above because, for example, different operating conditions and/or different priorities may result in different feedback loops being used in different situations. The various feedback loops discussed above may be used in various different combinations and subcombinations, and other suitable feedback loops may also be used.

As another example, it may be preferred in some situations, but is not required, that solely an acoustic underwater positioning system ("AUPS") be used to determine whether the vehicles' paths 54, 56 are in a substantially aligned formation while the vehicles 12, 16 are a predetermined distance from one another. The AUPS may be configured so that the towing vehicle 16 includes a transceiver of the AUPS and the towable vehicle 12 includes a beacon (e.g., a transponder) of the AUPS (or the positions of the transceiver and beacon may be reversed). The beacon is interrogated acoustically by the transceiver to determine the location of the beacon. In one specific example, the AUPS is an Ultra Short Baseline ("USBL") system that has one transceiver on the towing vehicle 16 and one beacon on the towable vehicle 12. At least in theory, it is believed that the USBL system could be used in feedback loop(s) to substantially maintain the vehicles' paths 54, 56 in their substantially aligned formation and the tow line 18 in its substantially curved formation. In accordance with the first embodiment of this disclosure, the towable vehicle's motor for propulsion is equipped with a controller for controlling the revolutions per minute ("RPM") of the motor, and the USBL system senses the relative X location (e.g., the relative horizontal positions) of the vehicles 12, 16 and when the feedback error is non-zero, the control system adjusts the RPM of the towable vehicle's motor in a manner that seeks to cause the feedback error to be zero. Alternatively and/or if necessary, desired or helpful, the feedback systems associated with the USBL system could be used in conjunction with one or more of the other feedback loops/systems discussed above, or any other suitable feedback system or combination of feedback systems may be used.

From a control perspective, the feedback control loops that have been discussed above may be characterized as being "outer loops". In accordance with the first embodiment of this disclosure, the system 10 (e.g., the towable vehicle 12) includes other feedback control loops, which may be referred to as "inner loops". The inner loops are for stabilizing the towable vehicle 12. The inner loops typically include angular rate feedback (pitch, yaw and roll rates) and angle feedbacks (pitch, roll, yaw) as well as nonlinear shaping/compensating filters. One of ordinary skill in the art will understand that such inner loops are not novel per se, and it has been conventional to use such inner loops in unmanned underwater vehicles. Any suitable inner loops may be used.

In the following, examples are presented of additional, theoretically calculated modes of operation in which the vehicles' paths 54, 56 are in their substantially aligned formation, in accordance with the first embodiment of this disclosure. Some of the calculated modes of operation are shown in FIGS. 5-9 and characterized by the data in Tables 1-5, which are presented below. Except for the "dead tow" modes of operation 10A, 10E, 10I, 10Q/tow lines 18A, 18E, 18I, 18Q, the lengths of the tow lines shown in FIGS. 5-9 extend from the towing vehicle 16 to the towable vehicle 12 and are respectively in substantially curved formations.

Figure 5:
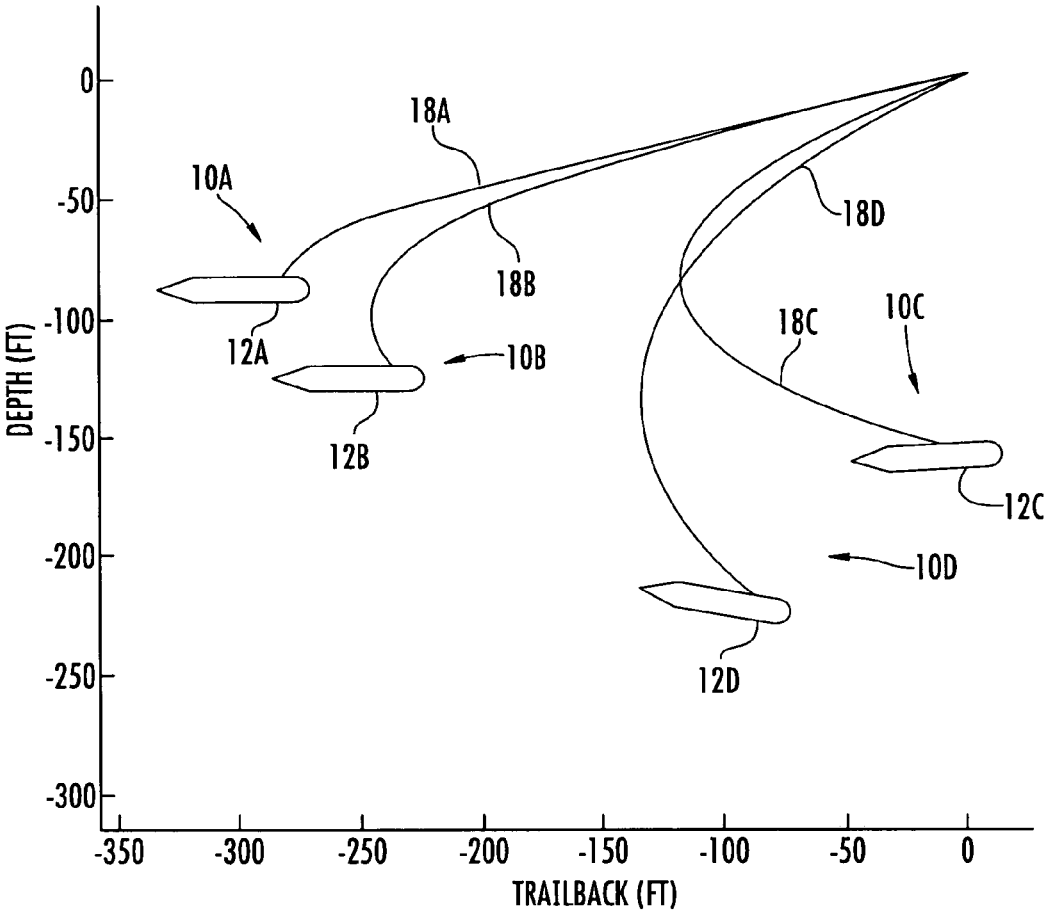
FIG. 5 is a chart that is, in some ways, similar to the chart of FIG. 4, and schematically illustrates theoretically calculated modes of operation selected from a first group, in accordance with the first embodiment of this disclosure.

FIG. 5 is a chart that includes isolated, schematic, left elevation views of lengths of the tow line 18 that extend from the towing vehicle 16 (not shown in FIG. 5) to the towable vehicle 12, with the tow line and the towable vehicle being shown in four different theoretically calculated configurations respectively corresponding to four different potential modes of operation 10A-10D for the system 10. Aspects of the four different modes of operation of FIG. 5 are included in Table 1.

The four different modes of operation 10A-10D schematically shown in FIG. 5 and characterized by Table 1 are part of a first group of modes operations ("the first group") that was theoretically calculated while holding a set of conditions fixed, in accordance with the first embodiment of this disclosure. The first group includes numerous modes of operation comprising the modes of operation 10A-10D and numerous other modes of operation (not shown in FIG. 5) that are respectively between the modes of operation 10A-10D. In FIG. 5, the modes of operation 10A-10D are respectively illustrated by the towable vehicle and tow line that are respectively identified with reference characters 12A-12D and 18A-18D.

The set of conditions that was held fixed when calculating the first group (e.g., the modes of operation 10A-10D) comprises: the towable vehicle 12 (i.e., the towable vehicles 12A-12D) each being 21 inches long; the strength cable 24/tow line 18 (i.e., tow lines 18A-18D) each having a length of 300 feet, a specific gravity of 4 and a diameter of 0.7 inches; each of the vehicles 16, 12 (i.e., 12A-12D) having a forward speed of 4 knots; the vehicles' paths 54, 56 respectively being in their substantially aligned formation; and the vehicles 16, 12 operating in steady state conditions (e.g., without any heave or surge).

In FIG. 5 and also in Table 1 (which is below), a "dead tow" mode of operation is designated by the reference character 10A, a "maximum steady" mode of operation is designated by the reference character 10B, a "zero trailback" mode of operation is designated by the reference character 10C, and a "maximum depth" mode of operation is designated by the reference character 10D. The relative term "maximum" and the relative terms regarding steadiness that are used in and/or with reference to FIG. 5 and Table 1 are based upon a comparison solely between the modes of operation of the first group.

TABLE 1

(e.g., 4 knots and 300 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| dead tow 10A | 0 | 0 | | 53.6 | poor |
| maximum steady 10B | 50 | 0.46 | 123 | 72.6 | best |
| zero trailback 10C | 88 | 0.81 | 154 | 87 | good |
| maximum depth 10D | 145 | 1.33 | 217 | 175.3 | very poor |

Table 1 indicates that the maximum tension in the tow line 18 increases from the dead tow mode of operation 10A to the maximum steady mode of operation 10B. Table 1's increase in the maximum tension from the dead tow mode of operation 10A to the maximum steady mode of operation 10B exists because, for example, the maximum tensions indicated in Table 1 were calculated for steady state conditions (e.g., without any heave or surge). At least when the towing vehicle 16 is exposed to sufficiently large heave and/or surge conditions, the maximum tension applied by the tow line 18B to the "maximum steady" towable vehicle 12B is less than the maximum tension applied by the tow line 18A to the "dead tow" towable vehicle 12A. During the sufficiently large heave and/or surge conditions, the maximum tension applied by the tow line 18B to the "maximum steady" towable vehicle 12B is less than the maximum tension applied by the tow line 18A to the "dead tow" towable vehicle 12A because, for example, of the "decoupling effect" provided by the tow line 18B being in a substantially curved formation. As a result, the "maximum steady" towable vehicle 12B travels more steadily than the "dead tow" towable vehicle 12A during the sufficiently large heave and/or surge conditions. Similarly, during sufficiently large heave and/or surge conditions, the maximum tension applied by the tow line 18C to the "zero tailback" towable vehicle 12C is less than the maximum tension applied by the tow line 18A to the "dead tow" towable vehicle 12A because, for example, of the "decoupling effect" provided by the tow line 18C being in a substantially curved formation.

Figure 6:
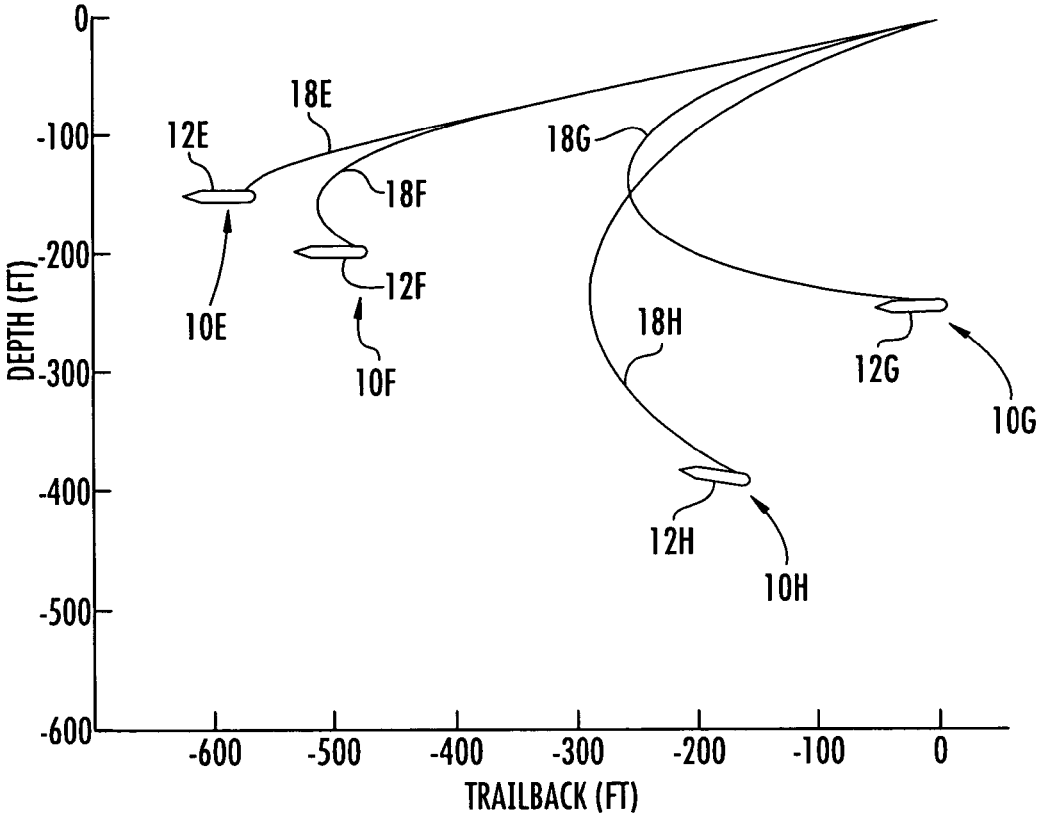
FIG. 6 is like FIG. 5, except that it is for a second group of theoretically calculated modes of operation, in accordance with the first embodiment of this disclosure.

FIG. 6 is like FIG. 5, except that FIG. 6 schematically illustrates modes of operation 10E-10H of a second group of modes of operation ("the second group") that was theoretically calculated while holding a set of conditions fixed, in accordance with the first embodiment of this disclosure. In FIG. 6, the modes of operation 10E-10H are respectively illustrated by the towable vehicle and tow line that are respectively identified with reference characters 12E-12H and 18E-18H. The four different modes of operation 10E-10H schematically shown in FIG. 6 are also characterized by Table 2, which is below.

The second group includes numerous modes of operation comprising the modes of operation 10E-10H and numerous other modes of operation (not shown in FIG. 6) that are respectively between the modes of operation 10E-10H. The set of conditions held fixed while calculating the second group (e.g., see FIG. 6 and Table 2) is like the set of conditions held fixed while calculating the first group (e.g., see FIG. 5 and Table 1), except for variations noted and any variations that will be apparent to one of ordinary skill in the art. The length of the strength cable 24/tow line 18 (i.e., 18E-18H) was held fixed at 600 feet while calculating the second group.

The In FIG. 6 and also in Table 2, a "dead tow" mode of operation is designated by the reference character 10E, a "maximum steady" mode of operation is designated by the reference character 10F, a "zero trailback" mode of operation is designated by the reference character 10G, and a "maximum depth" mode of operation is designated by the reference character 10H. The relative term "maximum" and the relative terms regarding steadiness that are used in and/or with reference to FIG. 6 and Table 2 are based upon a comparison solely between the numerous modes of operation of the second group.

TABLE 2

(e.g., 4 knots and 600 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| dead tow 10E | 0 | 0 | | 71.5 | poor |

TABLE 2-continued (e.g., 4 knots and 600 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| maximum steady 10F | 60 | 0.55 | 193 | 86.9 | best |
| zero trailback 10G | 112 | 1.03 | 233 | 116.4 | good |
| maximum depth 10H | 220 | 2.01 | 383 | 260.5 | very poor |

Figure 7:
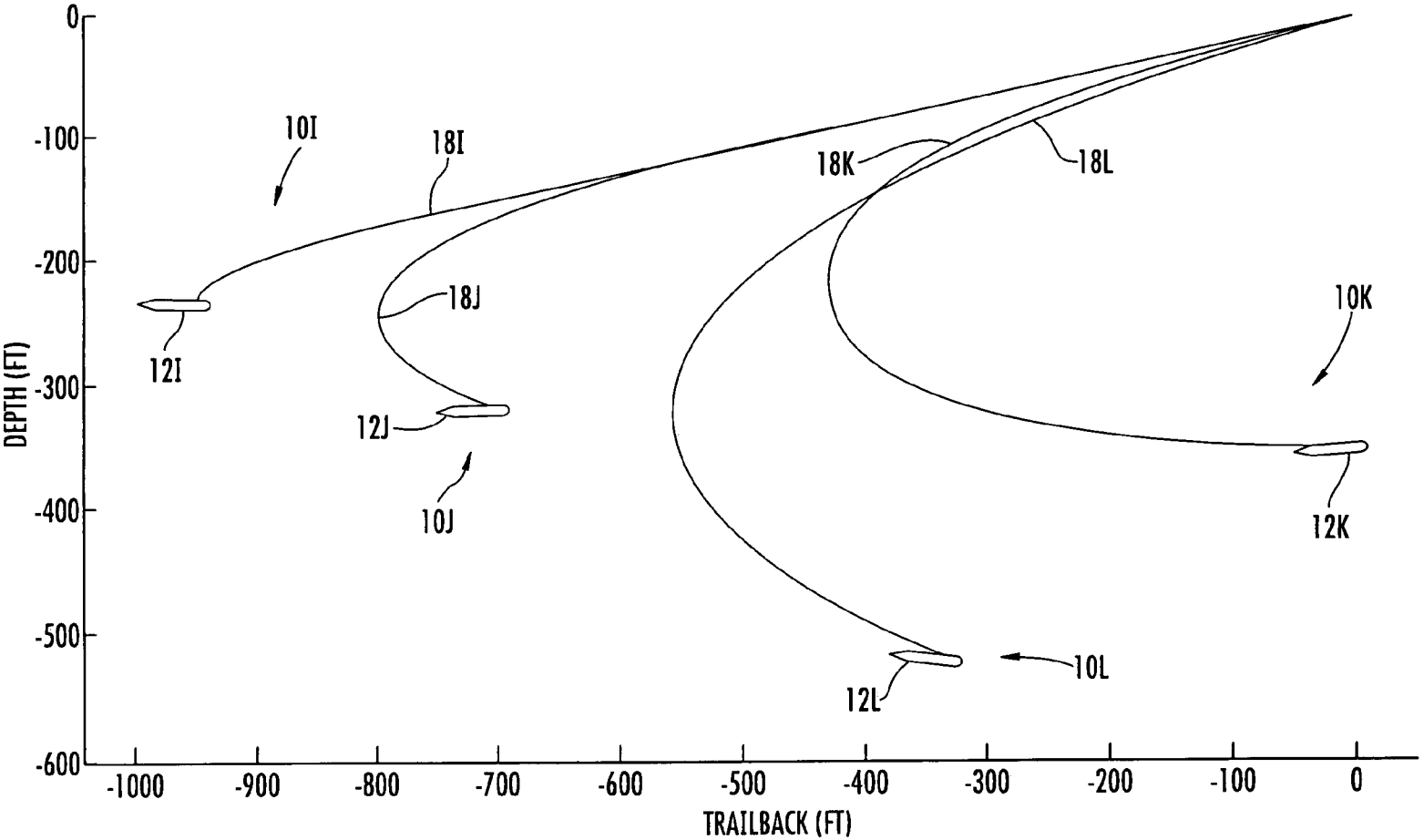
FIG. 7 is like FIG. 5, except that it is for a third group of theoretically calculated modes of operation, in accordance with the first embodiment of this disclosure.

FIG. 7 is like FIG. 5, except that FIG. 7 schematically illustrates modes of operation 10I-10L of a third group of modes of operation ("the third group") that was theoretically calculated while holding a set of conditions fixed, in accordance with the first embodiment of this disclosure. In FIG. 7, the modes of operation 10I-10L are respectively illustrated by the towable vehicle and tow line that are respectively identified with reference characters 12I-12L and 18I-18L. The four different modes of operation 10I-10L schematically shown in FIG. 7 are also characterized by Table 3, which is below.

The third group includes numerous modes of operations comprising the modes of operation 10I-10L and numerous other modes of operation (not shown in FIG. 7) that are respectively between the modes of operation 10I-10L. The set of conditions held fixed while calculating the third group (e.g., see FIG. 7 and Table 3) is like the set of conditions held fixed while calculating the first group (e.g., see FIG. 5 and Table 1), except for variations noted and any variations that will be apparent to one of ordinary skill in the art. The length of the strength cable 24/tow line 18 (i.e., 18I-18L) was held fixed at 984 feet while calculating the third group.

In FIG. 7 and also in Table 3, a "dead tow" mode of operation is designated by the reference character 10I, a "maximum steady" mode of operation is designated by the reference character 10J, a "zero trailback" mode of operation is designated by the reference character 10K, and a "maximum depth" mode of operation is designated by the reference character 10L. The relative term "maximum" and the relative terms regarding steadiness that are used in and/or with reference to FIG. 7 and Table 3 are based upon a comparison solely between the numerous modes of operation of the third group.

TABLE 3

(e.g., 4 knots and 984 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| dead tow 10I | 0 | 0 | | 94.3 | poor |
| maximum steady 10J | 90 | 0.82 | 314 | 134.5 | best |
| zero trailback 10K | 154 | 1.41 | 345 | 168.9 | good |
| maximum depth 10L | 240 | 2.20 | 514 | 293.6 | very poor |

As apparent from a comparison of theoretically calculated data from Tables 1-3 and in accordance with the first exemplary embodiment of this disclosure: the towable vehicle's thrust increases moderately with the length of the tow line/cable; the towable vehicle's motor shaft power increases moderately with the length of the tow line/cable; the towable vehicle's depth increases approximately linearly with the length of the tow line/cable; and the maximum tension in the tow line/cable increases approximately linearly with the length of the tow line/cable.

Figure 8:
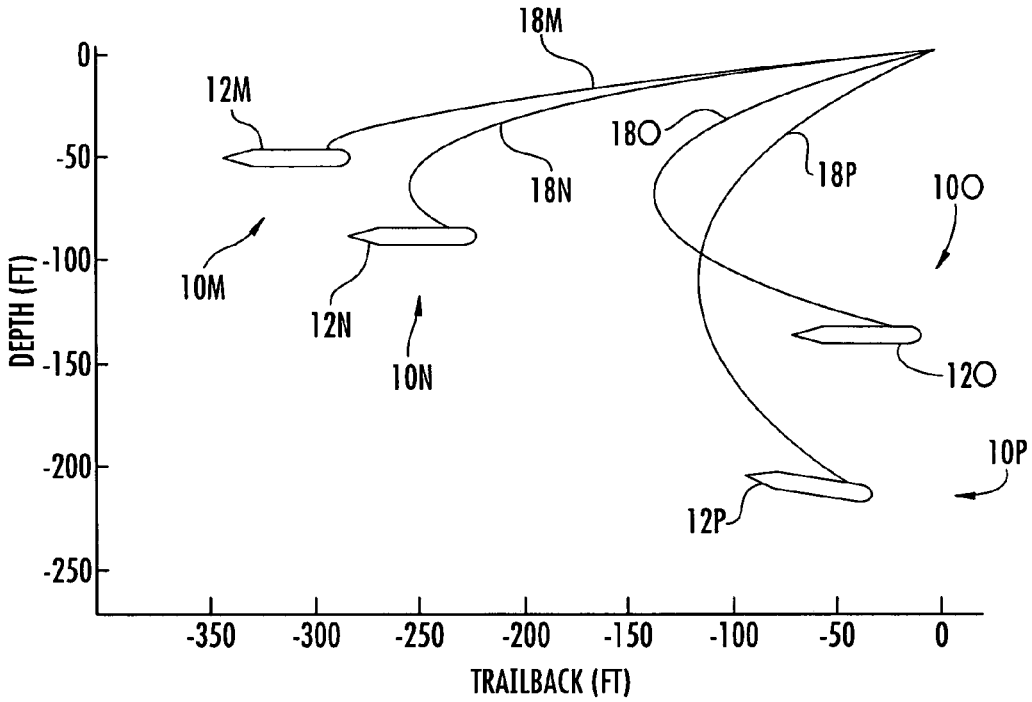
FIG. 8 is like FIG. 5, except that it is for a fourth group of theoretically calculated modes of operation, in accordance with the first embodiment of this disclosure.

FIG. 8 is like FIG. 5, except that FIG. 8 schematically illustrates modes of operation 10M-10P of a fourth group of modes of operation ("the fourth group") that was theoretically calculated while holding a set of conditions fixed, in accordance with the first embodiment of this disclosure. In FIG. 8, the modes of operation 10M-10P are respectively illustrated by the towable vehicle and tow line that are respectively identified with reference characters 12M-12P and 18M-18P. The four different modes of operation schematically shown in FIG. 8 are also characterized by Table 4, which is below.

The fourth group includes numerous modes of operations comprising the modes of operation 10M-10P and numerous other modes of operation (not shown in FIG. 8) that are respectively between the modes of operation 10M-10P. The set of conditions held fixed while calculating the fourth group (e.g., see FIG. 8 and Table 4) is like the set of conditions held fixed while calculating the first group (e.g., see FIG. 5 and Table 1), except for variations noted and any variations that will be apparent to one of ordinary skill in the art. The forward speed of each of the vehicles 16, 12 (i.e., 12M-12P) was held fixed at 7 knots while calculating the fourth group.

In FIG. 8 and also in Table 4, a "dead tow" mode of operation is designated by the reference character 10M, a "maximum steady" mode of operation is designated by the reference character 10N, a "zero tailback" mode of operation is designated by the reference character 10O, and a "maximum depth" mode of operation is designated by the reference character 10P. The relative term "maximum" and the relative terms regarding steadiness that are used in and/or with reference to FIG. 8 and Table 4 are based upon a comparison solely between the numerous modes of operation of the fourth group.

TABLE 4

(e.g., 7 knots and 300 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| dead tow 10M | 0 | 0 | | 90.1 | poor |
| maximum steady 10N | 120 | 1.92 | 86 | 127.6 | best |
| zero trailback 10O | 215 | 3.44 | 133 | 195.3 | good |
| maximum depth 10P | 440 | 7.05 | 210 | 456.7 | very poor |

Figure 9:
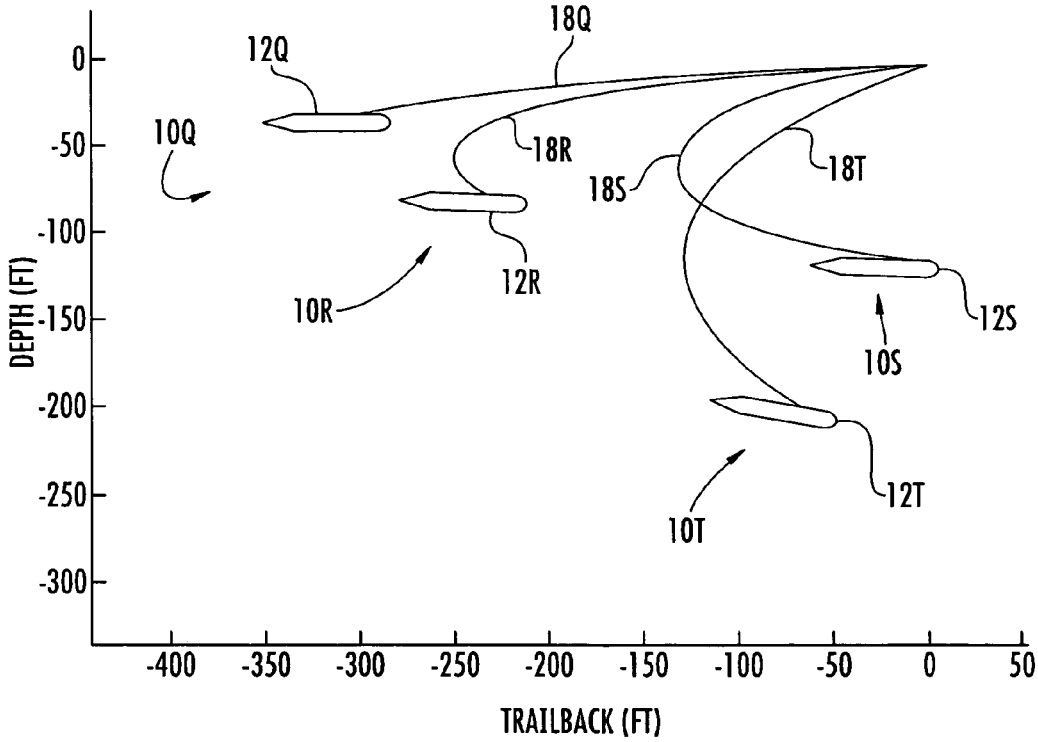
FIG. 9 is like FIG. 5, except that it is for a fifth group of theoretically calculated modes of operation, in accordance with the first embodiment of this disclosure.

FIG. 9 is like FIG. 5, except that FIG. 9 schematically illustrates modes of operation 10Q-10T of a fifth group of modes of operation ("the fifth group") that was theoretically calculated while holding a set of conditions fixed, in accordance with the first embodiment of this disclosure. In FIG. 9, the modes of operation 10Q-10T are respectively illustrated by the towable vehicle and tow line that are respectively identified with reference characters 12Q-12T and 18Q-18T. The four different modes of operation 10Q-10T schematically shown in FIG. 9 are also characterized by Table 5, which is below.

The fifth group includes numerous modes of operations comprising the modes of operation 10Q-10T and numerous other modes of operation (not shown in FIG. 9) that are respectively between the modes of operation 10Q-10T. The set of conditions held fixed while calculating the fifth group (e.g., see FIG. 9 and Table 5) is like the set of conditions held fixed while calculating the first group (e.g., see FIG. 5 and Table 1), except for variations noted and any variations that will be apparent to one of ordinary skill in the art. The forward speed of each of the vehicles 16, 12 (i.e., 12Q-12T) was held fixed at 10 knots while calculating the fifth group.

In FIG. 9 and also in Table 5, a "dead tow" mode of operation is designated by the reference character 10Q, a "maximum steady" mode of operation is designated by the reference character 10R, a "zero trailback" mode of operation is designated by the reference character 10S, and a "maximum depth" mode of operation is designated by the reference character 10T. The relative term "maximum" and the relative terms regarding steadiness that are used in and/or with reference to FIG. 9 and Table 5 are based upon a comparison solely between the numerous modes of operation of the fifth group.

TABLE 5

(e.g., 10 knots and 300 foot tow line/cable)

| Mode of Operation | Towable Vehicle's Thrust (lbs) | Towable Vehicle's Motor Shaft Power (kW) | Depth of Towable Vehicle (ft) | Maximum Tension in Tow Line/ Cable (lbs) | Steadiness of Towable Vehicle |
|---|---|---|---|---|---|
| dead tow 10Q | 0 | 0 | | 160.5 | poor |
| maximum steady 10R | 240 | 5.49 | 78 | 239.8 | best |
| zero trailback 10S | 365 | 8.35 | 112 | 304.5 | good |
| maximum depth 10T | 840 | 19.22 | 201 | 846.7 | very poor |

As apparent from a comparison of theoretically calculated data from Tables 1, 4 and 5, and in accordance with the first exemplary embodiment of this disclosure: the towable vehicle's thrust increases approximately with the square of the speed; the towable vehicle's motor shaft power increases approximately with the cube of the speed; the towable vehicle's depth decreases only slightly as the speed increases; and the maximum tension in the tow line/cable increases approximately with the square of the speed.

A second embodiment of this disclosure is like the first embodiment of this disclosure, except for variations noted and variations that will be apparent to one of ordinary skill in the art. In accordance with the second embodiment, the towing vehicle 16 is an unmanned underwater vehicle. The unmanned underwater vehicle may be operated in close vicinity to the wavy surface 20 of the body of water 14.

In accordance with one aspect of this disclosure and as best understood with reference to FIG. 2, the towable vehicle 12 may in some instances be referred to as a submerged vehicle, since it is sometimes submerged in the water 14.

In the foregoing examples, specific numerical values are provided as specific examples. Nonetheless, in this Detailed Description section of this disclosure, the specific numerical values can more generally be characterized as having the adjectives/adjective-like phrases "approximately", "substantially", "at least about", "greater than about" and/or "less than about" associated therewith. Also, those of ordinary skill will understand that the numerical values provided in the Detailed Description section of this disclosure are respectively related in a manner such that numerous numerical ranges are disclosed by this disclosure. Methods and/or features that are different than those described above, and are nonetheless suitable, may be utilized in carrying out the present invention.

It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A method of using a sensor that is carried by a vehicle that is submerged in water and connected to a towing vehicle by a length of a tow line that extends from the towing vehicle to the submerged vehicle, the method comprising simultaneously:

operating the sensor that is carried by the submerged vehicle;

operating the towing vehicle, comprising operating a propulsion system of the towing vehicle, so that the towing vehicle tows at least the tow line;

operating the submerged vehicle, comprising operating a propulsion system of the submerged vehicle, so that the propulsion system of the submerged vehicle is at least partially propelling the submerged vehicle, whereby the submerged vehicle is at least partially self-propelled; and coordinating the operating of the towing vehicle and the operating of the submerged vehicle so that each of the towing vehicle, the submerged vehicle and the entirety of the length of the tow line, which extends from the towing vehicle to the submerged vehicle, travels at substantially the same speed in substantially the same forward direction so that simultaneously the entirety of the length of the tow line is under tension, and the length of the tow line is curved in a manner that inhibits the length of the tow line from transferring oscillatory motion between opposite ends of the length of the tow line, comprising the length of the tow line defining a concave shape that is forwardly oriented, and the length of the tow line having an upper section, a lower section, and a farthest rearward point that is positioned between the upper section and the lower section, wherein the farthest rearward point of the length of the tow line is positioned at and defines a farthest rearward point of the concave shape, the upper section extends to the towing vehicle from the farthest rearward point, comprising the upper section extending upwardly and forwardly from the farthest rearward point toward the towing vehicle, and the upper section curving forwardly from the farthest rearward point toward the towing vehicle, so that the upper section defines an upper of the concave shape, and the lower section extends to the submerged vehicle from the farthest rearward point, comprising the lower section extending downwardly and forwardly from the farthest rearward point toward the submerged vehicle, and the lower section curving forwardly from the farthest rearward point toward the submerged vehicle, so that the lower section defines a lower portion of the concave shape.

2. The method according to claim 1, wherein the coordinating is carried out so that the submerged vehicle tows a portion of the tow line at the same time as the towing vehicle tows a portion of the tow line.

3. The method according to claim 1, wherein the coordinating is carried out so that the towing vehicle at least partially tows the submerged vehicle by way of the tow line while the propulsion system of the submerged vehicle is at least partially propelling the submerged vehicle.

4. The method according to claim 1, wherein a lower end of the length of the tow line is positioned forwardly of an upper portion of the tow line.

5. The method according to claim 1, further comprising the towing vehicle towing the submerged vehicle by way of the tow line prior to the operating of the propulsion system of the submerged vehicle.

6. The method according to claim 1, wherein the coordinating is carried by an autopilot system of the towable vehicle.

7. The method according to claim 1, wherein:

the towing vehicle is a boat floating at a surface of the water, and the submerged vehicle is an autonomous unmanned underwater vehicle that is submerged in the water.

8. The method according to claim 1, wherein the speed is at least about 3 knots.

9. The method according to claim 1, wherein the speed is at least about 7 knots.

10. The method according to claim 1, wherein the towing vehicle and the submerged vehicle traveling in substantially the same forward direction comprises:

the towing vehicle traveling along an upper path; and the submerged vehicle traveling along a lower path that is below and substantially parallel to the upper path.

11. The method according to claim 10, wherein the upper and lower paths are substantially vertically aligned with one another.

12. A method of using a sensor of a towable vehicle, the method comprising:

at least partially towing the towable vehicle under water, comprising connecting the towable vehicle and a towing vehicle to one another with a length of a tow line that extends from the towing vehicle to the towable vehicle, and operating a propulsion system of the towing vehicle, so that the towing vehicle is propelled by the propulsion system of the towing vehicle, and the towable vehicle is at least partially towed by the towing vehicle as a result of the towing vehicle being propelled by the propulsion system of the towing vehicle, so that towing tension is applied to the towable vehicle by way of the tow line;

coordinating operation of the towing vehicle and the towable vehicle in order to maintain the towable vehicle under water and at least reduce the towing tension applied to the towable vehicle by way of the tow line, wherein the coordinating comprises operating a propulsion system of the towable vehicle, so that the propulsion system of the towable vehicle is at least partially propelling the towable vehicle, whereby the towable vehicle is at least partially self-propelled, and wherein the coordinating is carried out so that simultaneously each of the towing vehicle, the towable vehicle and the entirety of the length of the tow line travels at substantially the same speed in substantially the same forward direction, the entirety of the length of the tow line is under tension, and the length of the tow line is curved in a manner that inhibits the length of the tow line from transferring oscillatory motion between opposite ends of the length of the tow line, comprising the length of the tow line defining a concave shape that is forwardly oriented, and the length of the tow line having an upper section, a lower section, and a farthest rearward point that is positioned between the upper section and the lower section, wherein the farthest rearward point of the length of the tow line is positioned at and defines a farthest rearward point of the concave shape, the upper section extends to the towing vehicle from the farthest rearward point, comprising the upper section extending upwardly and forwardly from the farthest rearward point toward the towing vehicle, and the upper section curving forwardly from the farthest rearward point toward the towing vehicle, so that the upper section defines an upper portion of the concave shape, and the lower section extends to the towable vehicle from the farthest rearward point, comprising the lower section extending downwardly and forwardly from the farthest rearward point toward the towable vehicle, and the lower section curving forwardly from the farthest rearward point toward the towable vehicle, so that the lower section defines a lower portion of the concave shape.

13. The method according to claim 12, wherein the coordinating comprises steering at least one of the towing vehicle and the towable vehicle.

14. The method according to claim 12, wherein the towing vehicle is a boat.

15. The method according to claim 12, wherein the sensor is a downwardly oriented sonar sensor.

16. The method according to claim 12, wherein the coordinating comprises adjusting the operating of the propulsion system of the towable vehicle, so that forward speed of the towable vehicle substantially matches forward speed of the towing vehicle.

17. The method according to claim 12, wherein the coordinating is carried out so that:

the towing vehicle pulls an upper end of the tow line so that the towing vehicle propels the upper end of the tow line, and the towable vehicle pulls a lower end of the tow line so that the towable vehicle propels the lower end of the tow line.

18. The method according to claim 12, comprising sending information via the tow line.

19. The method according to claim 12, comprising sending electrical power via the tow line.

20. A method of using a sensor of a towable vehicle, the method comprising:

at least partially towing the towable vehicle under water, comprising connecting the towable vehicle and a towing vehicle to one another with a tow line, and operating a propulsion system of the towing vehicle, so that towing tension is applied to the towable vehicle by way of the tow line;

coordinating operation of the towing vehicle and the towable vehicle in order to maintain the towable vehicle under water and at least reduce the towing tension applied to the towable vehicle by way of the tow line, wherein the coordinating comprises operating a propulsion system of the towable vehicle, so that the propulsion system of the towable vehicle is at least partially propelling the towable vehicle, whereby the towable vehicle is at least partially self-propelled, obtaining information indicative of the towing tension applied to the towable vehicle exceeding a predetermined value, and adjusting one or more operating parameters of one or more of the towing vehicle and the towable vehicle in a manner that seeks to at least reduce the towing tension applied to the towable vehicle by way of the tow line, wherein the adjusting is responsive to the obtaining of the information; and operating the sensor during the coordinating.

21. A method of using a sensor of a towable vehicle, the method comprising simultaneously performing a plurality of operations, wherein the plurality of operations, which are performed simultaneously, comprise:

propelling a towing vehicle along an upper path while the towing vehicle and the towable vehicle are connected to one another by a tow line, wherein the propelling of the towing vehicle comprises operating a propulsion system of the towing vehicle so that the towing vehicle is at least partially self-propelled;

propelling the towable vehicle along an underwater path, wherein the propelling of the towable vehicle comprises operating a propulsion system of the towable vehicle so that the towable vehicle is at least partially self-propelled;

maneuvering so that the underwater path and the upper path are substantially parallel to one another, and the underwater path is below the upper path, wherein the maneuvering comprises obtaining information indicative of how parallel the underwater and upper paths are to one another, and adjusting one or more operating parameters of one or more of the towing vehicle and the towable vehicle in a manner that seeks to maintain the underwater path and the upper path substantially parallel to one another, and the underwater path below the upper path; and operating the sensor of the towable vehicle.

22. The method according to claim 21, wherein the propelling of the towable vehicle comprises the towing vehicle at least partially towing the towable vehicle by way of the tow line.

23. The method according to claim 21, wherein the towing vehicle is a boat.

24. The method according to claim 21, wherein the sensor is a downwardly oriented sonar sensor.

25. The method according to claim 21, wherein the plurality of operations, which are performed simultaneously, comprises:

the towing vehicle pulling an upper end of the tow line so that the towing vehicle propels the upper end of the tow line along the upper path, and the towable vehicle pulling a lower end of the tow line so that the towable vehicle propels the lower end of the tow line along the underwater path.

26. The method according to claim 21, wherein the plurality of operations, which are performed simultaneously, comprises exposing the towable vehicle to towing tension via the tow line.

27. The method according to claim 21, comprising sending information and/or electrical power via the tow line.

28. The method according to claim 21, wherein the adjusting of the one or more operating parameters comprises steering the towable vehicle.

29. The method according to claim 28, wherein the steering of the towable vehicle comprises adjusting the steering of the towable vehicle in a manner that seeks to maintain the underwater path substantially parallel to the upper path.

30. The method according to claim 21, wherein the plurality of operations, which are performed simultaneously, further comprises controlling the propelling of at least one of the towing vehicle and the towable vehicle to maintain the towing vehicle at least slightly ahead of the towable vehicle.

* * * * *